US008753096B2

(12) United States Patent
Yu et al.

(10) Patent No.: US 8,753,096 B2
(45) Date of Patent: Jun. 17, 2014

(54) COMPRESSOR OVERLOAD PROTECTION DEVICE

(75) Inventors: Wen-Ho Yu, Taoyuan Hsien (TW); Chen-Nan Chu, Taoyuan Hsien (TW); Lung-Yi Yeh, Taoyuan Hsien (TW); Hsueh-Hsien Lu, Taoyuan Hsien (TW)

(73) Assignee: Rechi Precision Co., Ltd, Taoyuan Hsien (TW)

( * ) Notice: Subject to any disclaimer, the term of this patent is extended or adjusted under 35 U.S.C. 154(b) by 580 days.

(21) Appl. No.: 13/007,690

(22) Filed: Jan. 17, 2011

(65) Prior Publication Data

US 2012/0183414 A1 Jul. 19, 2012

(51) Int. Cl.
*F04B 35/04* (2006.01)

(52) U.S. Cl.
USPC ..... 417/44.11; 62/228.4; 62/229

(58) Field of Classification Search
CPC ..... F04B 35/04; F04B 2203/0401; F04B 2203/0402
USPC ..... 417/44.1, 44.11; 62/228.4, 229
See application file for complete search history.

(56) References Cited

U.S. PATENT DOCUMENTS 6,398,507 B1 * 6/2002 Choi ..... 417/32

* cited by examiner

*Primary Examiner* — Charles Freay
*Assistant Examiner* — Patrick Hamo
(74) *Attorney, Agent, or Firm* — Jackson IPG PLLC

(57) ABSTRACT

A compressor overload protection device utilizes a first electrode of an electric connector to electrically connect a first OLP overload protection loop that is electrically connected to a first power line of an external power source. In addition, a second OLP overload protection loop is connected to a second electrode and a third electrode of the electric connector, and a capacitor is electrically connected between the third electrode and the first electrode. When the operation of the compressor is overloaded, the first and second OLP overload protection loop can provide proper protection mechanism with respect to the first power line and the second power line to prevent a motor of the compressor from being overheated and damaged, and the electrodes of the electric connector can be effectively prevented from exploding.

5 Claims, 6 Drawing Sheets

COMPRESSOR OVERLOAD PROTECTION DEVICE

BACKGROUND OF THE INVENTION

1. Field of the Invention

The present invention relates to an overload protection device, and more particularly to a compressor overload protection device applied to an overheated motor of a compressor to prevent it from being damaged.

2. Description of the Related Art

A compressor is widely applied to electric products such as a refrigerator, an air conditioner, a dryer, a heat pump water heater or a dehumidifier. A motor, which is driven by power, is disposed in the compressor to drive a pump for operation to provide compression effect on entered/exhausted gas. To prevent the motor from being overheated and damaged due to overload operation, an overload protection loop is usually disposed in a conventional compressor.

As shown in FIG. 1, a conventional compressor overload protection device 20 is mainly to dispose an OLP overload protection loop 20 outside of a casing 11 of a compressor 10. An electric connector 12 of the compressor 10 is electrically connected to an external power source through the OLP overload protection loop 20, and the OLP overload protection loop 20 is utilized to provide a desire protection effect on a connected power line L1 when the operation of the compressor is overloaded. It can prevent the motor of the compressor from being overheated and damaged due to overload operation.

However, the conventional compressor is connected to an external power source through two power lines L1, L2. When the motor of the conventional compressor 10 is in short circuit, the connected power line L1 is merely protected by the OLP overload protection loop 20, and another power line L2 is still in conducting state. Contacts electrically connected to the power line L2 and the electric connector 12 may explode due to the conducting of instant heavy current.

SUMMARY OF THE INVENTION

In view of the shortcomings of the prior art, the inventor(s) of the present invention based on years of experience in the related industry to conduct extensive researches and experiments, and finally developed a compressor overload protection device that prevents a motor of a compressor from being overheated and damaged and capable of effectively preventing electrodes from exploding.

To achieve the foregoing objective, the compressor overload protection device of the invention is to dispose an electric connector at a casing of a compressor to compose an electric connection between the motor inside the casing and an external power source. The electric connector utilizes a first electrode to electrically connect a first OLP overload protection loop that is electrically connected to a first power line of an external power source, and a second OLP overload protection loop is connected to a second electrode and a third electrode of the electric connector, and a capacitor is electrically connected between the third electrode and the first electrode.

Accordingly, the external power source electrifies a first power line and a second power line or simultaneously electrifies the first power line and the second power line. When the operation of the compressor is overloaded, under the effect of the first OLP overload protection loop, and a proper protection mechanism is provided with respect to the first power line and the second power line to prevent the motor of the compressor from being overheated and damaged, and the electrodes of the electric connector can be effectively prevented from exploding.

When the compressor overload protection device of the invention is implemented, the first OLP overload protection loop is disposed inside the casing of the compressor, and the second OLP overload protection loop is disposed outside of the casing of the compressor.

When the compressor overload protection device of the invention is implemented, the first OLP overload protection loop is disposed outside of the casing of the compressor, and the second OLP overload protection loop is disposed inside the casing of the compressor.

When the compressor overload protection device of the invention is implemented, the first OLP overload protection device and the second OLP overload protection device are disposed outside of the casing of the compressor.

When the compressor overload protection device of the invention is implemented, the first OLP overload protection device and the second OLP overload protection device are disposed inside the casing of the compressor.

By comparing with the conventional compressor overload protection device, the compressor overload protection device of the invention provides a proper protection mechanism with respect to the first power line and the second power line connected to the external power source when the operation of the compressor is overloaded. The motor of the compressor can be prevented from being overheated and damaged, and the electrodes of the electric connector can be effectively prevented from exploding. The safety of the operation of the compressor can be relatively improved, and the ratability of the compressor can be relatively enhanced.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
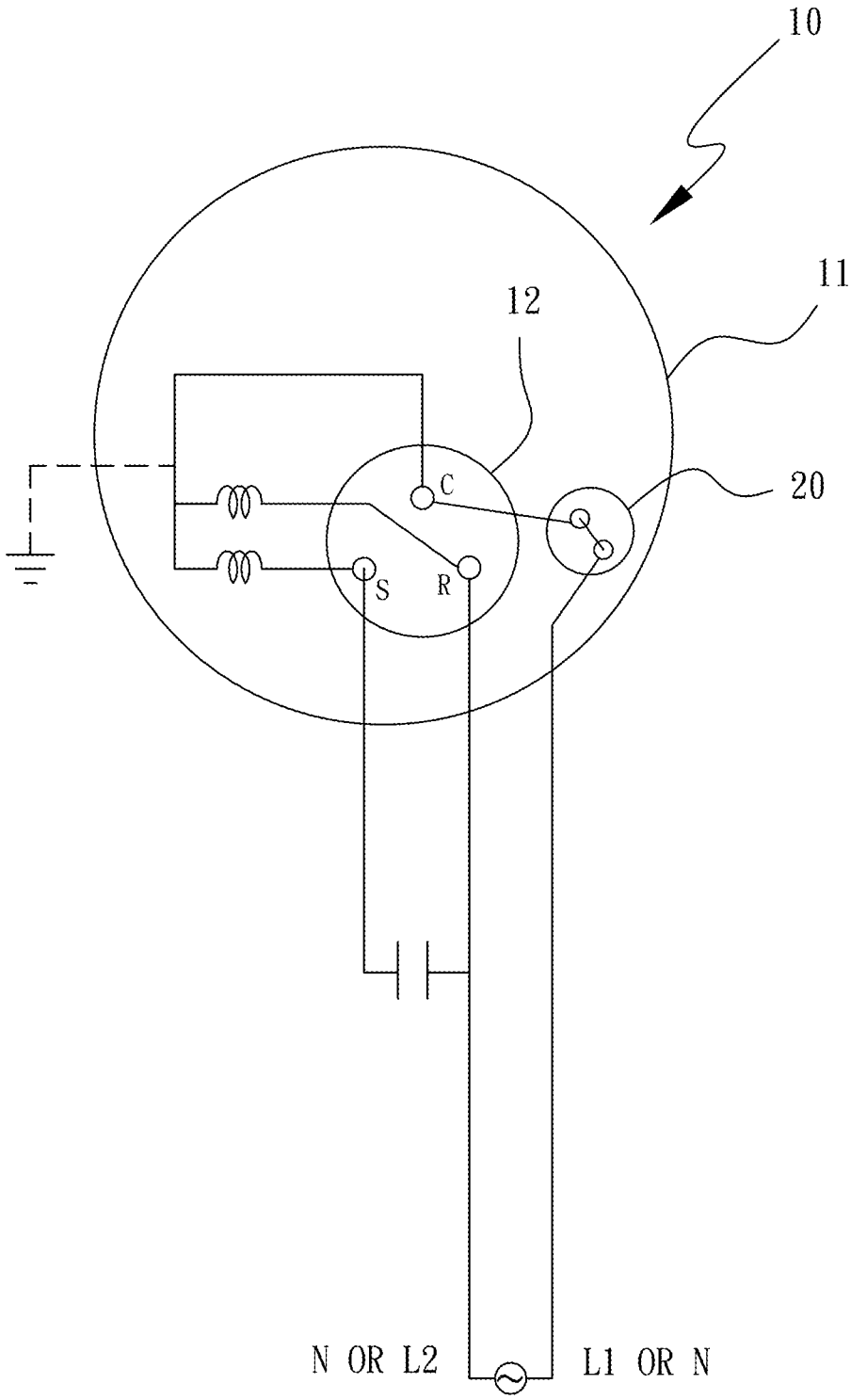
FIG. 1 PRIOR ART
FIG. 1 is a schematic diagram of circuit architecture of a conventional compressor overload protection device.
Figure 2:
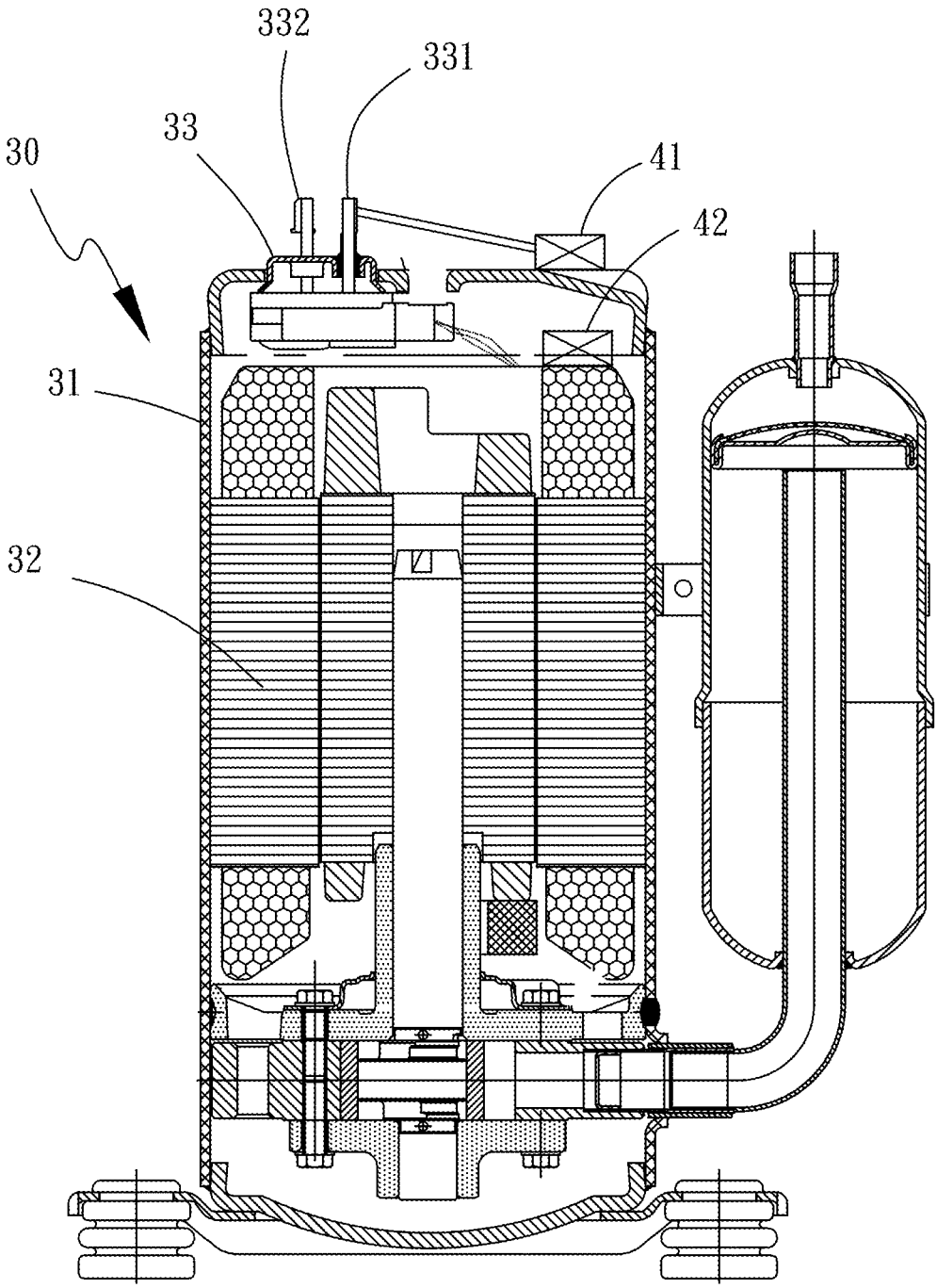
FIG. 2 is a cross-sectional drawing of a compressor overload protection device according to a first embodiment of the present invention.
Figure 3:
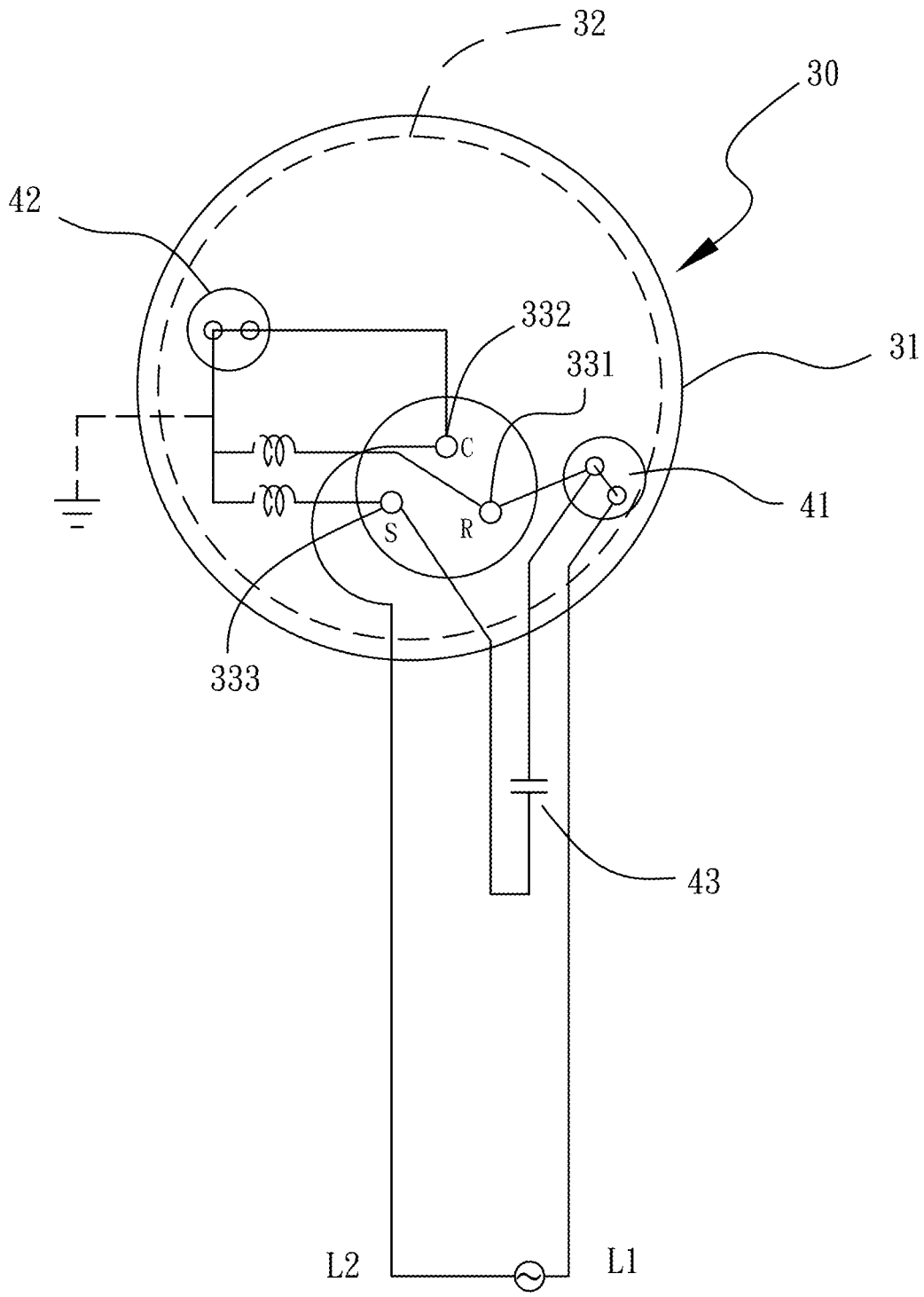
FIG. 3 is a schematic diagram of circuit architecture of a compressor overload protection device according to a first embodiment of the present invention.

With reference to FIG. 2 for a structural cross-sectional drawing of a compressor overload protection device in accordance with a first embodiment of the invention and with reference for a schematic diagram of a circuit diagram of a compressor overload protection device in accordance with a first embodiment of the invention are depicted. The compressor overload protection device of the invention is to dispose an electric connector 33 at a casing 31 of a compressor 30 to compose an electric connection between a motor 32 inside the casing 31 and an external power source.

The electric connector 33 utilizes a first electrode 331 to electrically connect a first OLP overload protection loop 41 so as to electrically connect a first power line L1 of the external power source through the first OLP overload protection loop 41. In addition, a second OLP overload protection loop 42 is connected to a second electrode 332 and a third electrode 333 of the electric connector 33. A capacitor 43 is electrically connected between the third electrode 333 and the first electrode 331, and the second electrode 332 is electrically connected to a second power line L2 of the external power source.

Figure 4:
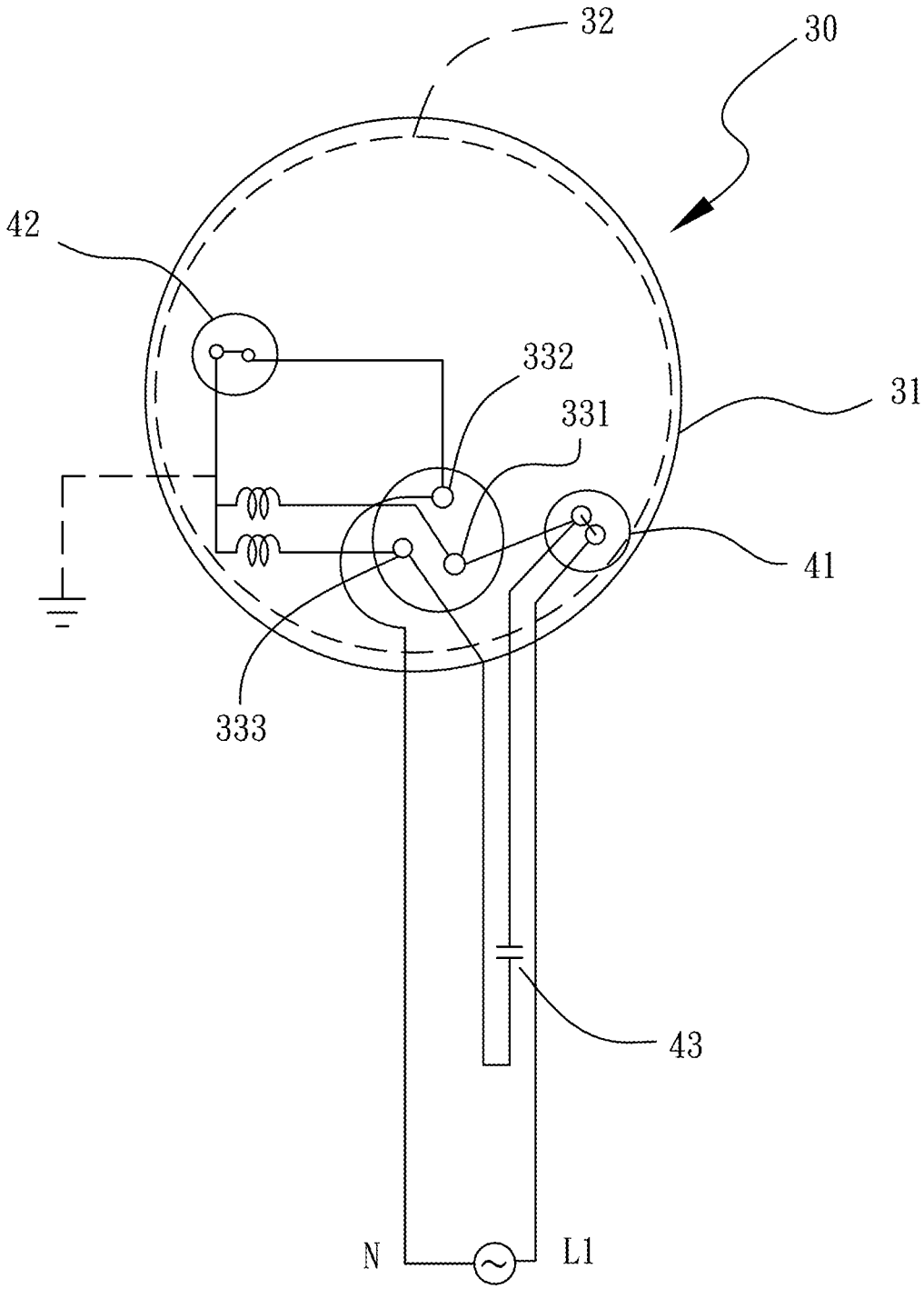
FIG. 4 is a reference diagram of a first allocation circuitry according to the present invention.
Figure 5:
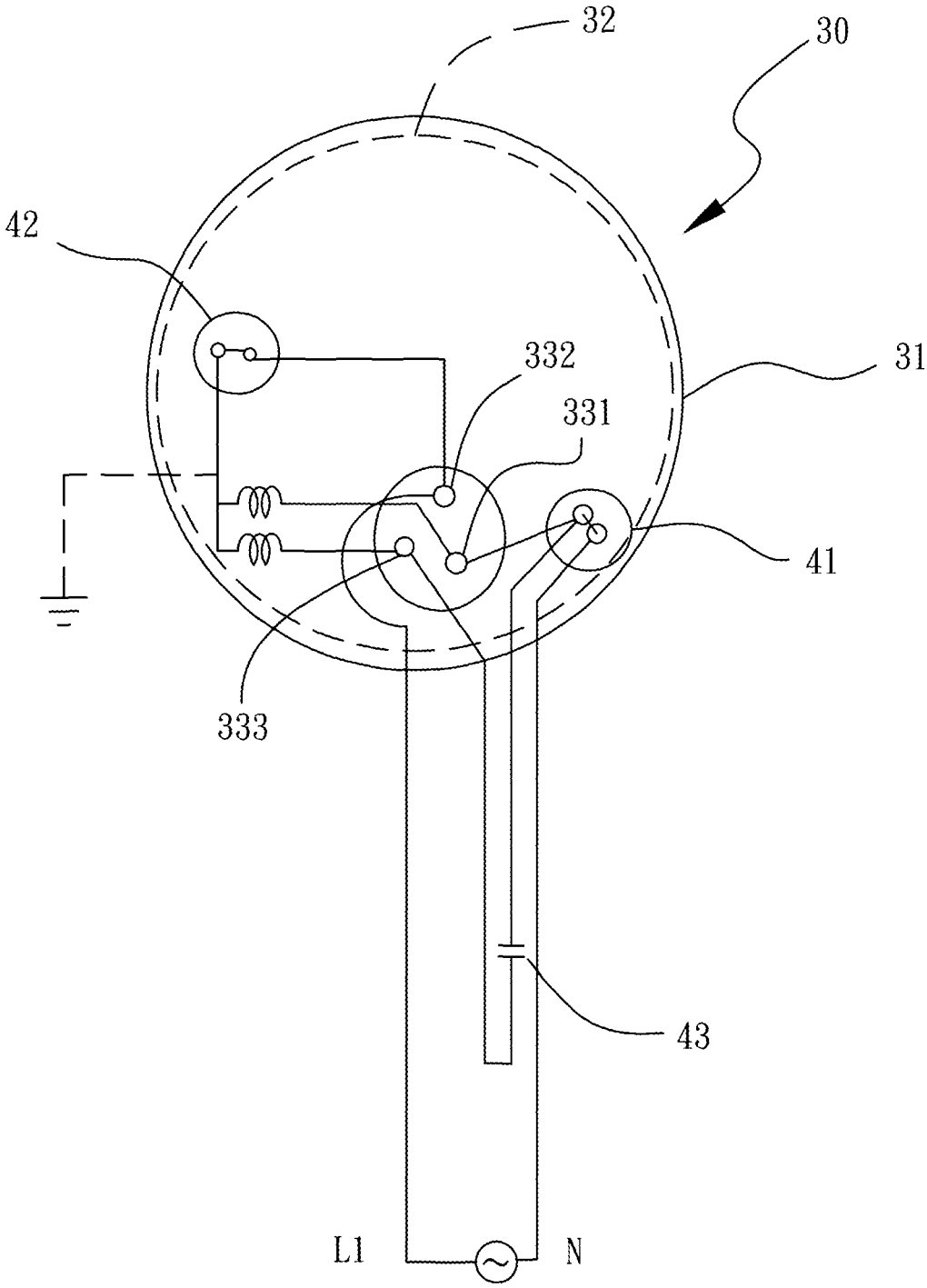
FIG. 5 is a reference diagram of a second allocation circuitry according to the present invention.
Figure 6:
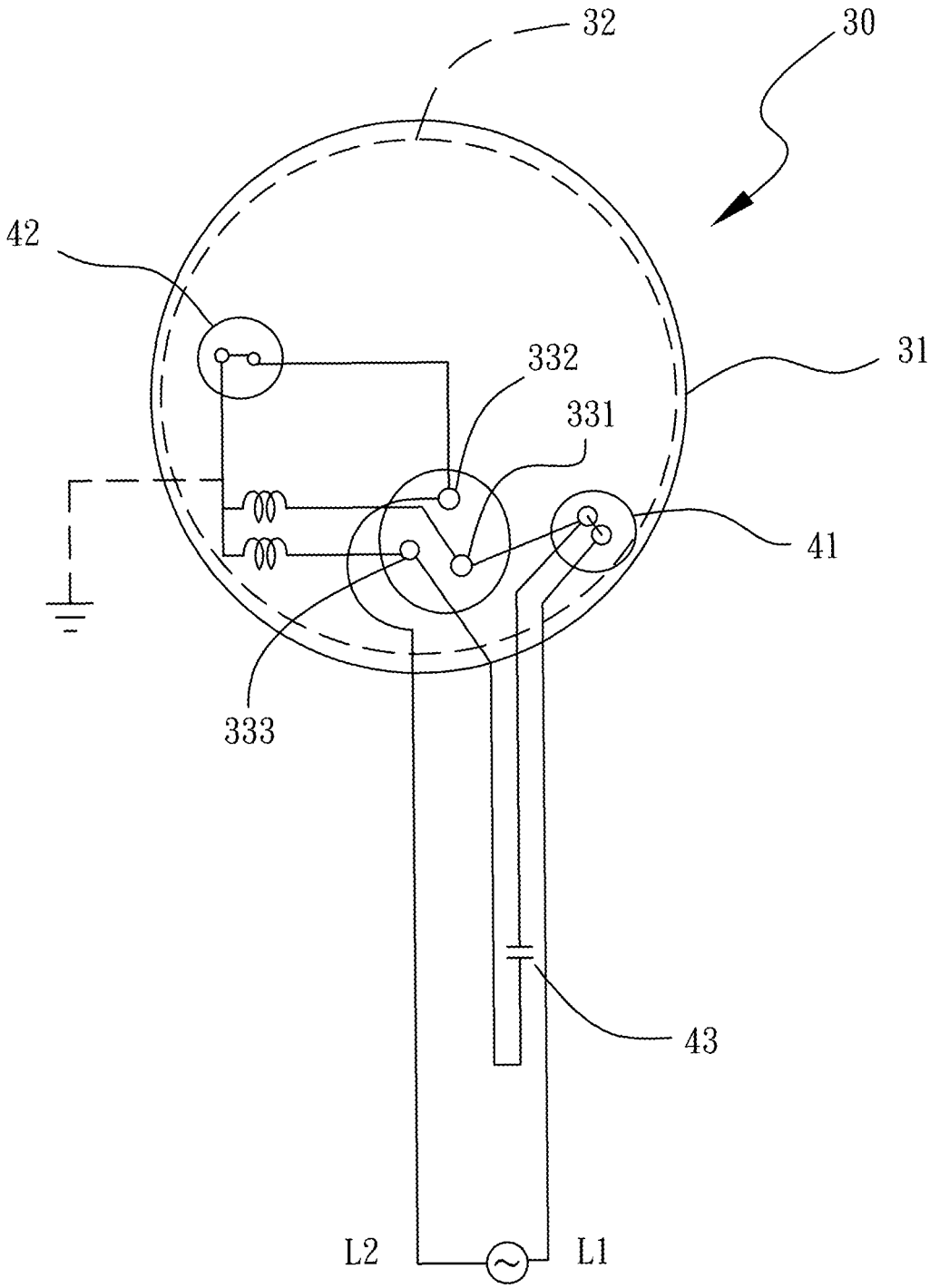
FIG. 6 is reference diagram of a third allocation circuitry according to the present invention.

Accordingly, the compressor overload protection device of the invention can utilize the first power line L1 to receive electricity of the external power source as shown in FIG. 4 and utilize the second power line L2 to receive electricity of the external power source as shown in FIG. 5 or simultaneously utilizes the first power line L1 and the second power line L2 to receive electricity of the external power source as shown in FIG. 6.

Alternatively, the external power source electrifies the first power line L1 or the second power line L2 or simultaneously electrifies the first power line L1 and the second power line L2. When the operation of the compressor 30 is overloaded, under effects of the first OLP overload protection loop 41 and the second OLP overload protection loop 42, a proper protection mechanism is produced with respect to the first power line L1 and the second power line. The motor 32 of the compressor 30 can be prevented from being overheated and damaged, and electrodes of the electric connector 33 can be effectively prevented from exploding.

More specifically, technique features of the invention can select disposing the first OLP overload protection loop 41 inside the casing 31 of the compressor 30 based upon the actual design demand of the compressor 30 and disposing the second OLP overload protection loop 42 outside the casing of the compressor 30. Alternatively, the first OLP overload protection loop 41 can be disposed outside of the casing 31 of the compressor 30, and the second OLP overload protection loop 42 can be disposed inside the casing 31 of the compressor 30.

Of course, the first OLP overload protection loop 41 and the second OLP overload protection loop 42 are simultaneously disposed outside of the casing 31 of the compressor 30. Alternatively, the first OLP overload protection loop 41 and the second OLP overload protection loop 42 are simultaneously disposed inside the casing 31 of the compressor 30 to achieve efficiencies of preventing the motor 32 of the compressor 30 from being damaged due to overheating and effectively preventing the electrodes from exploding.

Actually, when the operation of the compressor 30 is overloaded, the compressor overload protection device of the invention can provide a proper protection mechanism with respect to the first power line and the second power line connected to the external power source to prevent the motor 32 of the compressor 30 from being overheated and damaged and effectively prevent the electric connector 33 from exploding. Therefore, the safety of the operation of the compressor 30 can be relatively improved to relatively enhance the reliability of the compressor 30.

The compressor overload protection device of the invention improves over the prior art and complies with patent application requirements, and thus is duly filed for this patent application. While the invention has been described by device of specific embodiments, numerous modifications and variations could be made thereto by those generally skilled in the art without departing from the scope and spirit of the invention set forth in the claims.

What is claimed is:

1. A compressor overload protection device comprising:

an electric connector having a first electrode, a second electrode and a third electrode and disposed at a casing of a compressor to establish electric connection between a motor inside the casing and an external power source having a first power line and a second power line electrically connected to the second electrode;

a first OLP overload protection loop electrically connected to and coupled between the first electrode and the first power line;

a second OLP overload protection loop arranged in parallel to the first OLP overload protection loop and coupled between the second electrode and the third electrode of the electric connector; and a capacitor electrically connected between the third electrode and the first electrode.

2. The compressor overload protection device as recited in claim 1, wherein the first OLP overload protection loop is disposed inside the casing of the compressor, and the second OLP overload protection loop is disposed outside of the casing of the compressor.

3. The compressor overload protection device as recited in claim 1, wherein the first OLP overload protection loop is disposed outside of the casing of the compressor, and the second OLP overload protection loop is disposed inside the casing of the compressor.

4. The compressor overload protection device as recited in claim 1, wherein the first OLP overload protection loop and the second OLP overload protection loop are disposed outside of the casing of the compressor.

5. The compressor overload protection device as recited in claim 1, wherein the first OLP overload protection loop and the second OLP overload protection loop are disposed inside the casing of the compressor.

* * * * *